US007415857B1

(12) United States Patent
Petricio Yaksic

(10) Patent No.: US 7,415,857 B1
(45) Date of Patent: Aug. 26, 2008

(54) PLATE BENDING MACHINES AND METHODS

(76) Inventor: Davor Petricio Yaksic, La Colpa 681, Sector la Chimba, Casilla 902, Antofagasta (CL)

( * ) Notice: Subject to any disclaimer, the term of this patent is extended or adjusted under 35 U.S.C. 154(b) by 306 days.

(21) Appl. No.: 11/165,300

(22) Filed: Jun. 24, 2005

(51) Int. Cl.
*B21D 5/04* (2006.01)
*B21D 9/05* (2006.01)

(52) U.S. Cl. ..... 72/308; 72/316; 72/388; 72/389.3; 72/390.4

(58) Field of Classification Search ..... 72/316, 72/389.1, 389.3, 389.6, 390.4, 390.5, 308, 72/388, 466
See application file for complete search history.

(56) References Cited

U.S. PATENT DOCUMENTS 1,365,854 A * 1/1921 Rodgers ..... 72/381
3,335,588 A * 8/1967 Cummings ..... 72/388
3,834,210 A * 9/1974 Clavin et al. ..... 72/308
4,658,624 A * 4/1987 Ridgway et al. ..... 72/316
4,815,308 A 3/1989 Moroney
4,829,806 A * 5/1989 Wright ..... 72/459
5,222,384 A * 6/1993 Evans ..... 72/31.05
5,359,872 A 11/1994 Nashiki
5,901,600 A * 5/1999 Decker ..... 72/388
6,185,975 B1 2/2001 Nicoletti
6,711,927 B2 3/2004 Furuyama et al.

* cited by examiner

*Primary Examiner*—David B Jones
(74) *Attorney, Agent, or Firm*—James Creighton Wray; Clifford D. Hyra

(57) ABSTRACT

A step-by-step bending machine has a first movable bending member, a second cooperating adjustably fixed bending member, and a third central positionally fixed bending member on an opposite side of a plate to be bent from the first and second members and positioned between the first and second members. The second and third members hold the plate while the first member bends the plate against the third central member. The second member is positionally adjustable to accommodate thickness of the plate. The first member is positioned by cooperating pairs of positioning rams and is moved against the plate by parallel main rams.

19 Claims, 12 Drawing Sheets

SIDE VIEW

TOP VIEW

PLATE BENDING MACHINES AND METHODS

BACKGROUND OF THE INVENTION

To bend plates, plate bending roll machines are used. In the case of extreme plate thickness, a high tonnage press brake is used. Greater efforts to bend plates occurs in the initial pinch, when the thickness of a plate is too large or when the plate is extremely tough. Those factors require use of extremely heavy and powerful machines.

Needs exist for lighter bending machines and methods which are capable of bending thick, strong plates.

SUMMARY OF THE INVENTION

The new plate bending machines use about a third of the force and at least about half of the weight of plate bending roll machines or press brakes for bending the same plates.

A step-by-step bending machine has a first movable bending member, a second cooperating adjustably fixed bending member, and a third central positionally fixed bending member on an opposite side of a plate to be bent from the first and second members and positioned between the first and second members. The second and third members hold the plate while the first member bends the plate against the third central member. The second member is positionally adjustable to accommodate thickness of the plate. The first member is positioned by cooperating pairs of link rams and is moved against the plate by parallel rams.

A preferred bending machine apparatus uses a main frame having first and second side frames. A mobile frame is connected to the main frame for moving relatively to the main frame. A mobile first bending member is connected to the mobile frame for moving with the mobile frame with respect to the main frame.

A second bending member is connected between the first and second side frames and is spaced inward in the main frame from the first bending member. A third bending member is connected between the first and second side frames and is positioned between and in opposition to the first and second bending members.

In one embodiment, the third bending member is a fixed upper plate in the main frame, and the second bending member is a lower plate.

Preferably the lower plate is adjustable with respect to the upper plate. A bottom fixed plate and a shaft extend between the side frames beneath the lower plate. The shaft has opposite threads on opposite ends. A driver rotates the shaft. Wedges mounted on the opposite ends of the shaft and positioned between the bottom plate and the lower plate move inwardly or outwardly to slightly raise or lower the lower plate between inward extending guides on the first and second side frames.

The second plates and third bending members are connected to the side frames by threaded pins extending through aligned side bores in the side frame and in the upper and lower bending members. The pins have threaded inner ends which engage threaded bores at bottoms of the aligned bores in the bending members.

The mobile frame is connected to the main frame by parallel links pivoted on opposite ends to the side frames and to the mobile frame. Preferably the links are parallel positioning rams for moving the bottom, the top or both the top and bottom of the mobile frame inward or outward and repositioning or realigning the mobile first bending member with respect to the second and third bending members, away from parallel alignments or toward or away from the second and third bending members.

Guides extend outward from the side frames and overly the links for constraining the links for movement in planes parallel to the side plates.

Rams connected between the side frames and the mobile frame move the mobile frame and the mobile first bending member with respect to the side frames and the second and third bending members.

The mobile frame has mobile end frames in alignment with the side frames. The rams are in alignment between the side frames and the end frames and are connected between projections on the side frames extending toward the end frames, and projections on the end frames extending toward the side frames.

The new method of bending thick plates applies a central fixed force, applies a fixed force in an opposite direction spaced from the first central fixed force, and applies a mobile force in an opposite direction from the first central fixed force and spaced from the first central fixed force in a direction away from the second fixed force. The second fixed force and the mobile force are resisted by the central fixed force.

Preferably the second fixed force is adjustable in spacing with respect to the central fixed force.

The method further includes tipping the mobile force in an angular relation to the central fixed force.

The new method includes providing a frame having spaced first and second side frames, providing a mobile first forcer spaced from the frame for providing a first mobile force to a plate, providing a second forcer in the frame spaced from the first forcer for providing a second force to the plate in a direction similar to the first force, providing a third forcer fixed in the frame and positioned between the first and second forcers for providing a third force to the plate in a direction opposite to the direction of the first and second forces, moving the first forcer toward the plate and bending the plate between the forcers, and forming the plate in a curve.

A mobile first forcer is fixed in movable end frames aligned with and spaced from the side frames. The side frames and adjacent end frames are connected with parallel links. Rams between the end frames and the side frames move the side frames and move the first forcer against the plate to be bent, bending the plate.

Guides on the side frames guide the links and maintain alignment of the stationary side frames and mobile end frames.

Auxiliary rams are provided as the links and move the end plates and the first forcer outward or inward or tipped with respect to the second and third forcers.

Preferably the forcers are supports having edges contacting the plate. The second support is mounted adjustably in the side frames. A shaft has oppositely threaded end portions and wedges mounted on the end portions. Moving the wedges inward and outward by rotating the shaft in opposite directions raises or lowers the second support.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
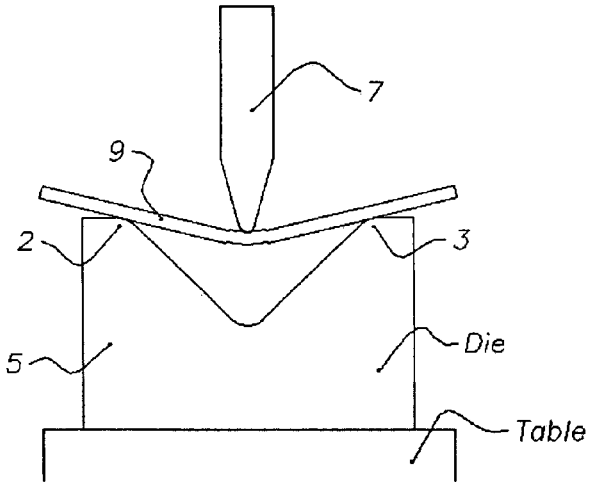
FIG. 1 shows how a prior art press brake applies the force F1 in its mobile part when bending a plate.
Figure 2:
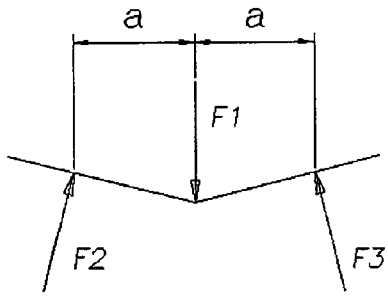
FIG. 2 PRIOR ART
FIG. 2 is a detail of the applied movable force F1 and fixed resistant forces F2 and F3 in the prior art press brake shown in FIG. 1.

Referring to FIG. 1, a prior art press brake bending machine 1 is schematically shown. The machine has two spaced lower fixed supports 2, 3 on a die 5 and a movable center ram 7 for bending a plate 9. A force diagram is shown in FIG. 2, wherein ram 7 provides a mobile force F1, and supports 2 and 3 provide support forces F2 and F3 on plate 9. A force couple and moment provide the bending. The center ram force F3 equals F1 plus F2.

Figure 3:
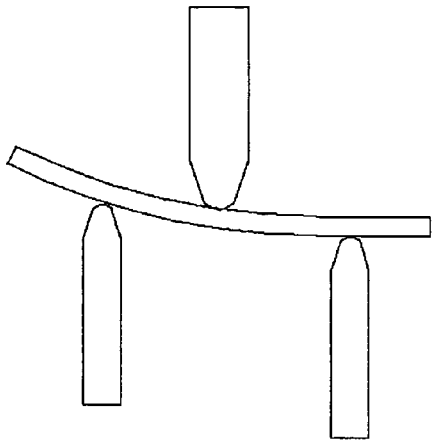
FIG. 3 schematically shows how the new bending machine applies the force F1 when bending a plate.
Figure 4:
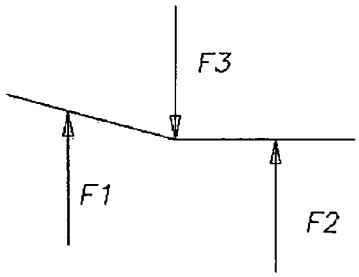
FIG. 4 is a bending force detail of the bending shown in FIG. 3. F1 is the mobile bending force.

An embodiment of the invention is shown in the bending machine 10 shown in FIGS. 3 and 4. An adjustable, fixed back support 12 and a rigid upper support 13 provides forces F2 and F3, as shown in FIG. 4. A mobile ram 17 provides the force F1 on an outer part of plate 19. As shown in FIG. 4, moment arms are equal.

Since F1 plus F2 equals F3 and only the moment F1*a* is provided by ram 17, a smaller force is required on ram 17, as compared to the force on ram 7 shown in FIG. 1, for providing the bending of a similar plate.

In force diagram FIGS. 2, 4, 6, 7 and 8. F1 denotes the movable bending force, and F2 and F3 are fixed or adjustably fixed in the case of FIG. 2.

Figure 5:
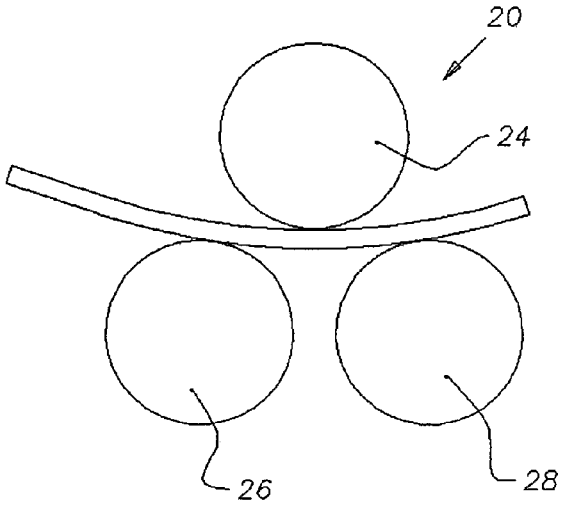
FIG. 5 shows how a plate bending roll machine can apply a mobile force in either of the lower rolls according to the invention.

FIG. 5 shows a roller bending machine 20 which bends a plate between rollers.

Figure 6:
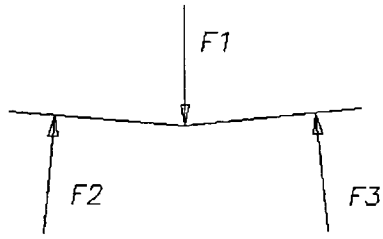
FIG. 6 shows a prior art movable force F1 application.

When the center roller 24 was movable and the back support rollers 26, 28 were fixed, bending plate 29 required the force vectors shown in FIG. 6, wherein F1 (the movable force) is equal to the sum of F2 and F3.

Figure 7:
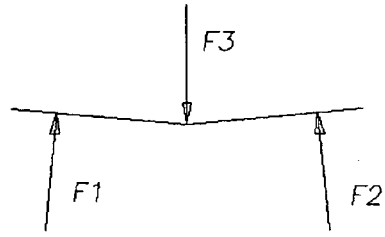
FIGS. 7 and 8 show movable forces F1 applied according to the present invention by either of the outer rollers.
Figure 8:
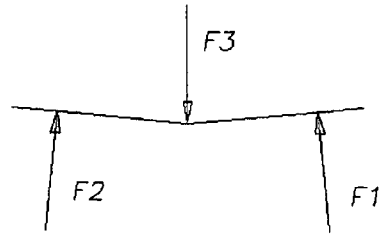

In the present invention, fixing the center top roller 24 and one of the back support rollers, either 26 or 28, requires about only half of the ram force F1, since F1 equals F3 minus F2, as shown in FIGS. 7 and 8.

A similar saving in force moment is realized. When the moment arms between F1 and F3 are increased, the required movable force F1 is decreased.

Figure 9A:
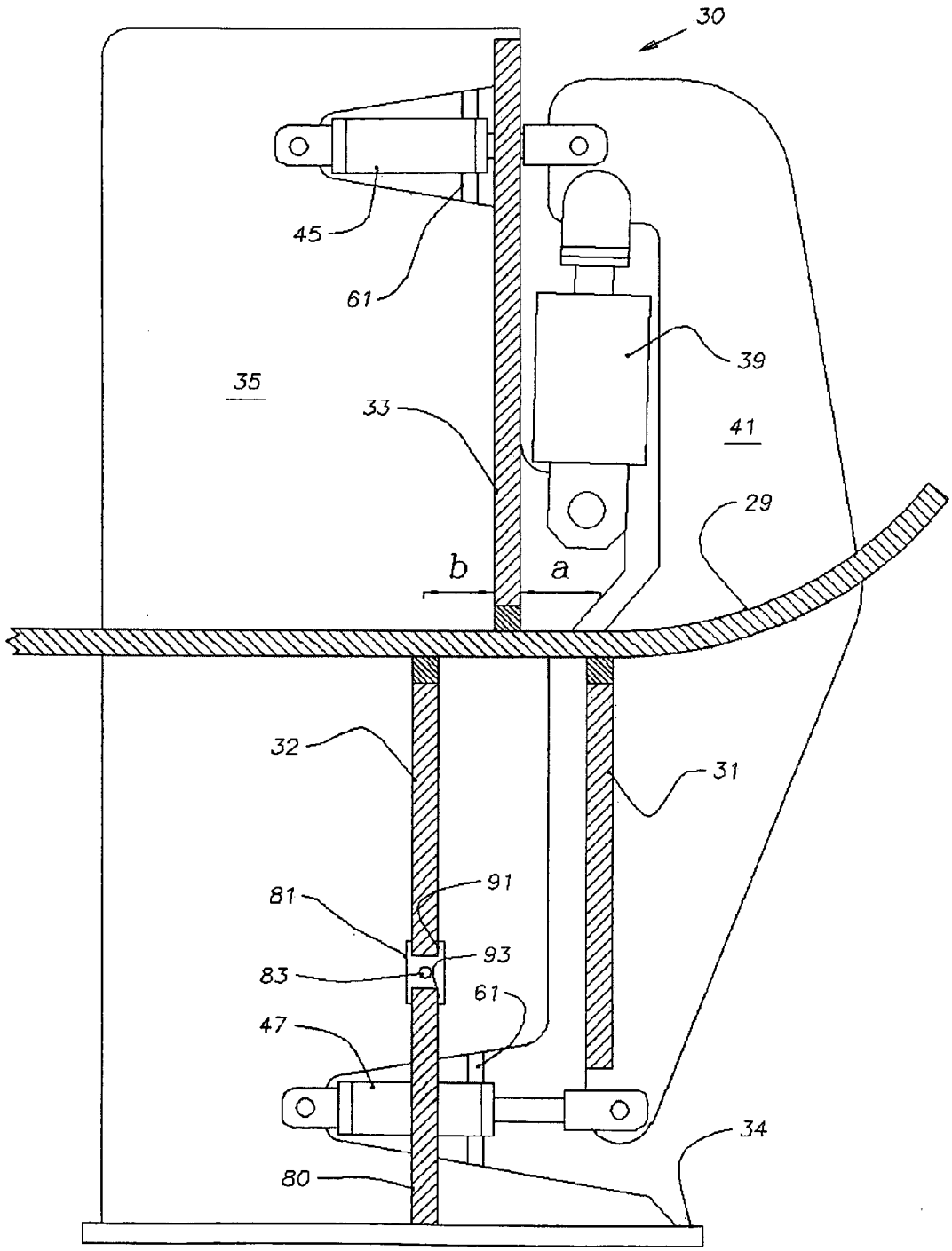
FIG. 9A is a schematic partially cross-sectional view showing the inside of a fixed right side frame and movable right end frame of a bending machine. The bending members are shown in cross-section and are constructed as bending plates according to one embodiment of the invention.
Figure 9B:
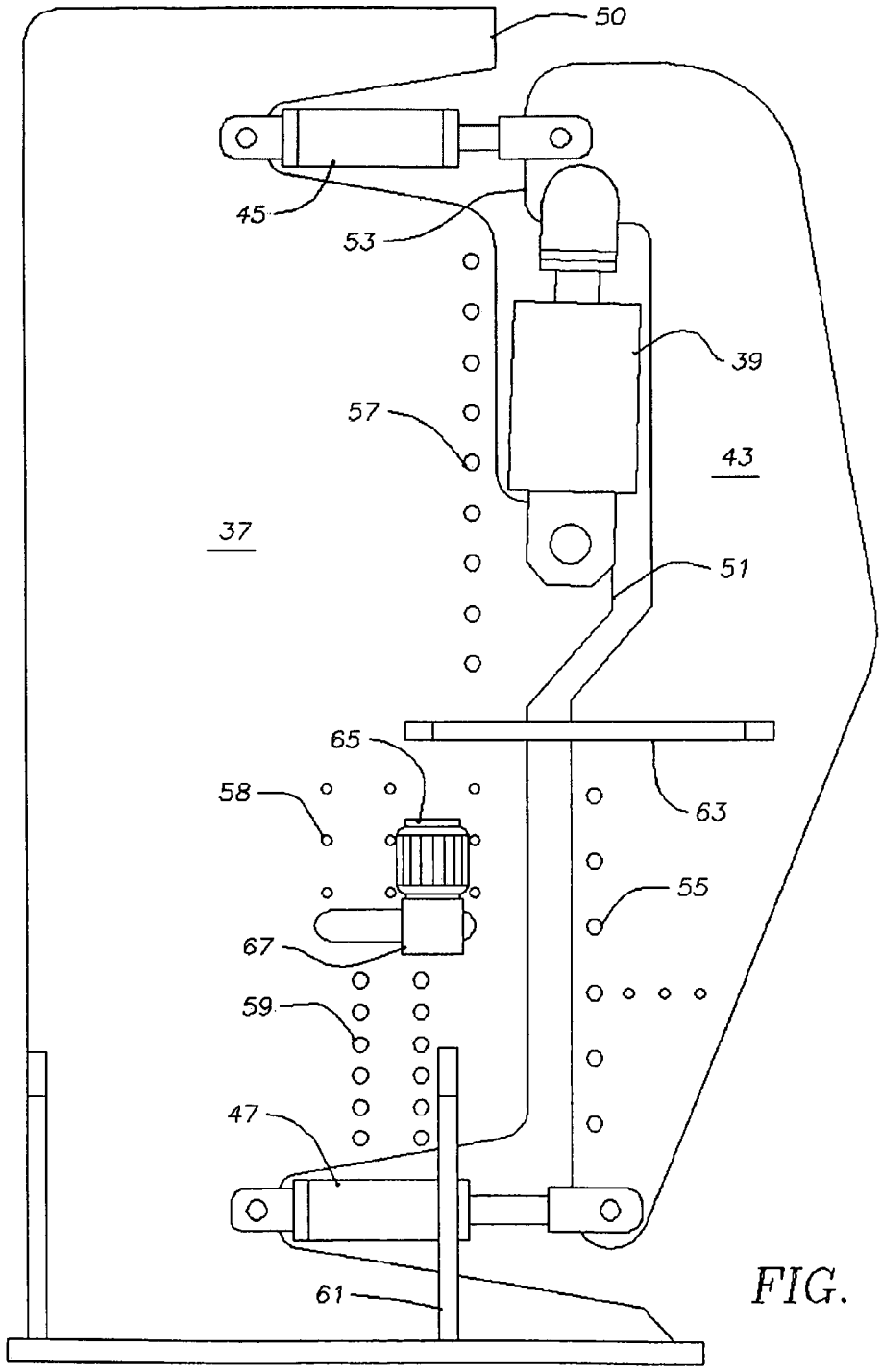
FIG. 9B is a left side elevation of the new plate bending machine showing a left side frame and a left movable end frame.

FIGS. 9A and 9B are views of a new bending machine 30 taken from the left side. FIG. 9A is a schematic cross-sectional view showing the force-applying members 31, 32, 33 in cross-section and showing the base 34, the insides of the right side frame 35, and right movable end frame 41, right main ram 39, and right adjusting and positioning rams 45 and 47. As main ram 39 is extended, plate 29 is bent by mobile member 21, while members 32 and 33 hold the plate. Plate 29 is shown in stepped position ready for the next bending by raising end frame 41 and bending member 31. Bending proceeds step-by-step until the plate is fully bent as required.

The distance a between fixed bending member 33 a mobile bending member 31 is greater than the distance b between the fixed upper support 33 and the adjustable lower support 32. F33 equals F31 plus F32. Moment F31*a* equals moment F32*b*, a>b. Therefore F31<F32<F33. The force required by ram 39 and the load on end frame 41 are significantly reduced in the present bending machine. Rams 45 and 45 may be extended together to increase the moment arm b. Extending rams 45, 47 differentially tips bending member 31 in relation to fixed bending member 33.

Guides 61 welded on the outside of side frame 35 prevent laterally outward displacement of rams 45 and 47. An end view of wedge 81 is shown with upper groove 91 and lower groove 93. Wedges move laterally between the side frames on threaded shaft 83 to raise or lower the adjustable lower bending member 32.

FIG. 9B shows an elevation of the left side frame 37 and the left end frame 43. Left and right main rams 39 are mounted between outward projections 51 on the fronts 50 of the side frames 35, 37 and inward projections 53 at tops of the end frames 41, 43.

Aligned bores 55 in the end frames 41, 43 receive threaded pins that fit in bores and are threaded into counter bores in side edges of the mobile bending member 31.

Aligned bores 57 in side frames 35 and 37 receive threaded pins that fit in and are threaded into threaded counter bores in side edges of the fixed upper bending member 33.

Aligned bores 58 and 59 in side frames 35, 37 receive threaded pins that fit in bores and are threaded into counter bores in parallel vertical guides for adjustable lower bending member 32 and in bores in side edges of the bottom member 80.

Guides 61 and 63 are welded to outer sides of side frames 35, 37 to maintain alignment of the side frames and mobile end frames 41, 43 by constraining lateral mobility of the paired links and positioning rams 45, 47.

Side frame-mounted motor 65 and speed reducer 67 drive a shaft for adjusting height of the adjustable bending member 32.

Figure 10:
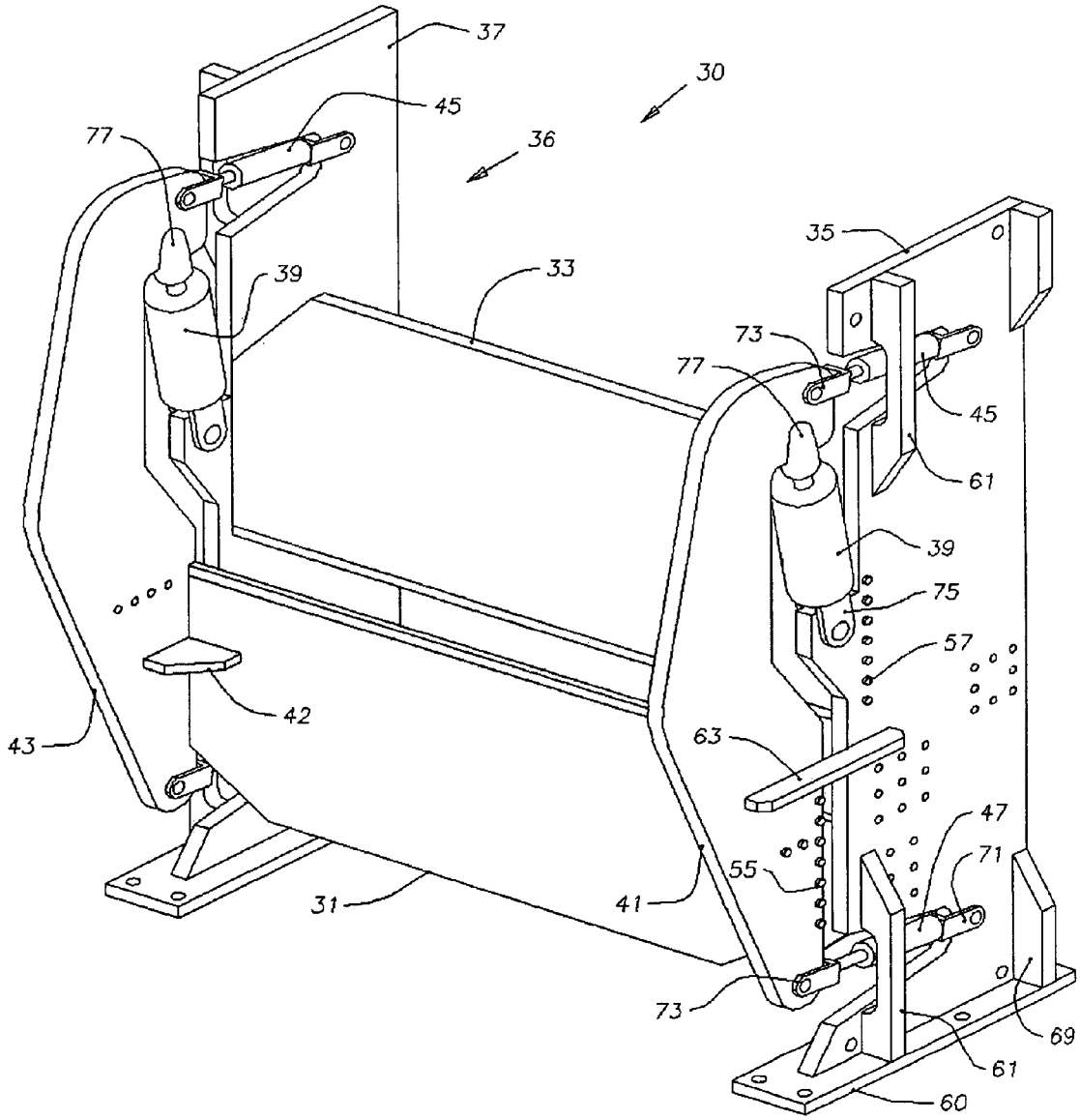
FIG. 10 is a front and right side perspective view of an assembled plate bending machine.

FIG. 10 is a perspective front view of the bending machine 30 showing frame 36, with the right side frame 35 and the left side frame 37. Movable end frames 41, 43 rigidly support mobile bending member 31. Gussets 42 welded to the member 31 and end frames 41, 43 laterally support the bending member 31, which is connected between the end frames by threaded pins in bores 55. Main rams 39 move the end frames 41, 43 and mobile bending member 31 upward.

Paired positioning rams 45, 47 move the end frames and bending member 31 inward or outward with respect to the fixed upper bending member 33 for decreasing or increasing the moment arm between members 31 and 33. Alternatively, the positioning rams 45, 47 tilt the member 31 with respect to member 33.

Guides 61 and 63 are welded to the side frames to constrain lateral movement. Alternatively, guides 63 may be welded to the end plates instead of the side plates.

Lower guides 61 and supports 69 are also welded to the base 60 to support the side frames.

The ends of the positioning rams are pivotally connected by clevises 71 and 73 to the fixed side frames and the mobile end frames. Main rams 39 are connected to the side frames by devises 75 and to the end frames by ball joints 77.

Figure 11:
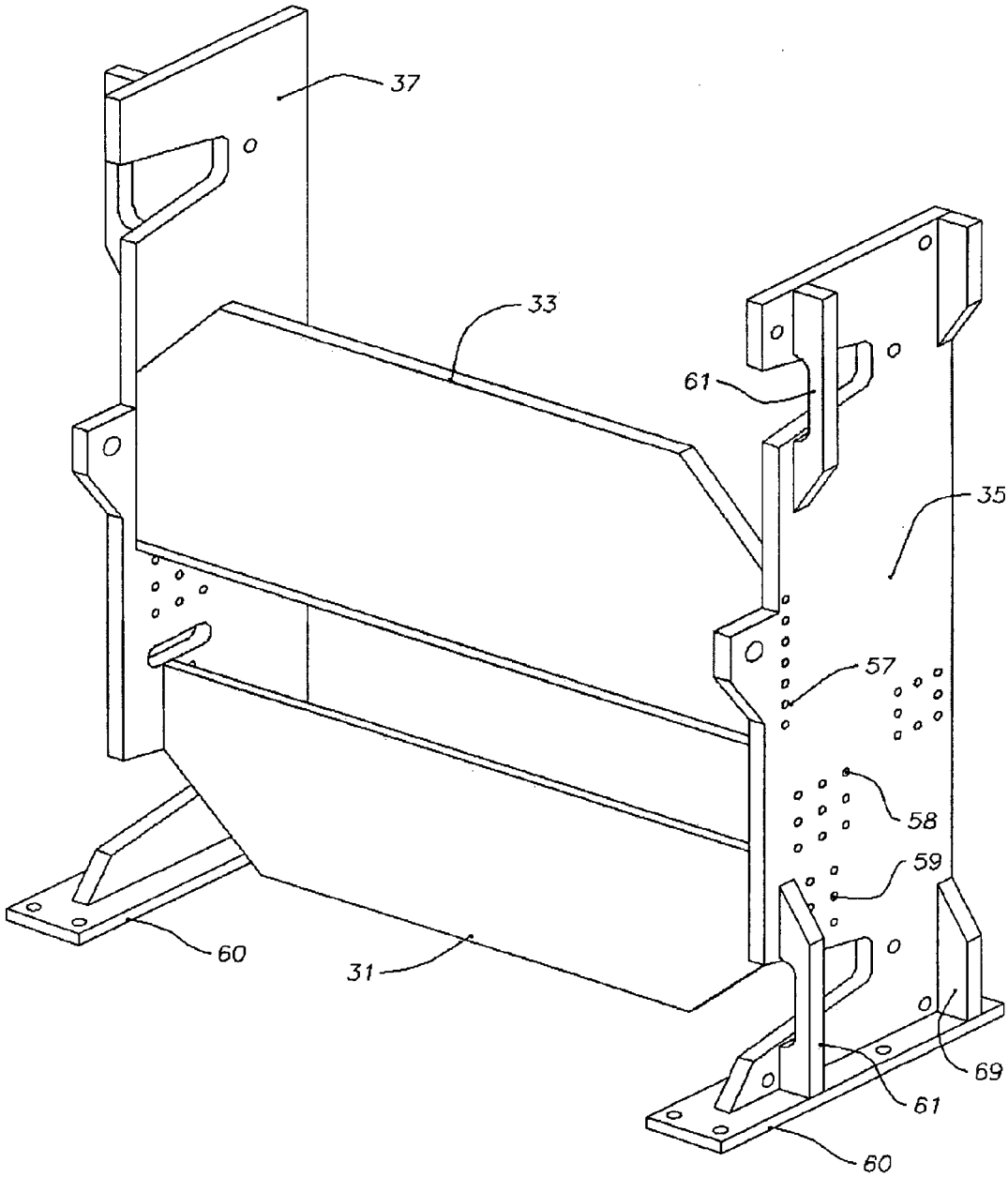
FIG. 11 is a front and right side perspective view showing side frames and a fixed upper bending member and a bottom plate.

FIG. 11 is a right side front perspective view of the frame 36, side frames 35, 37 and fixed upper bending member 33. A bottom member 80 is fixed between the end plates.

Figure 12:
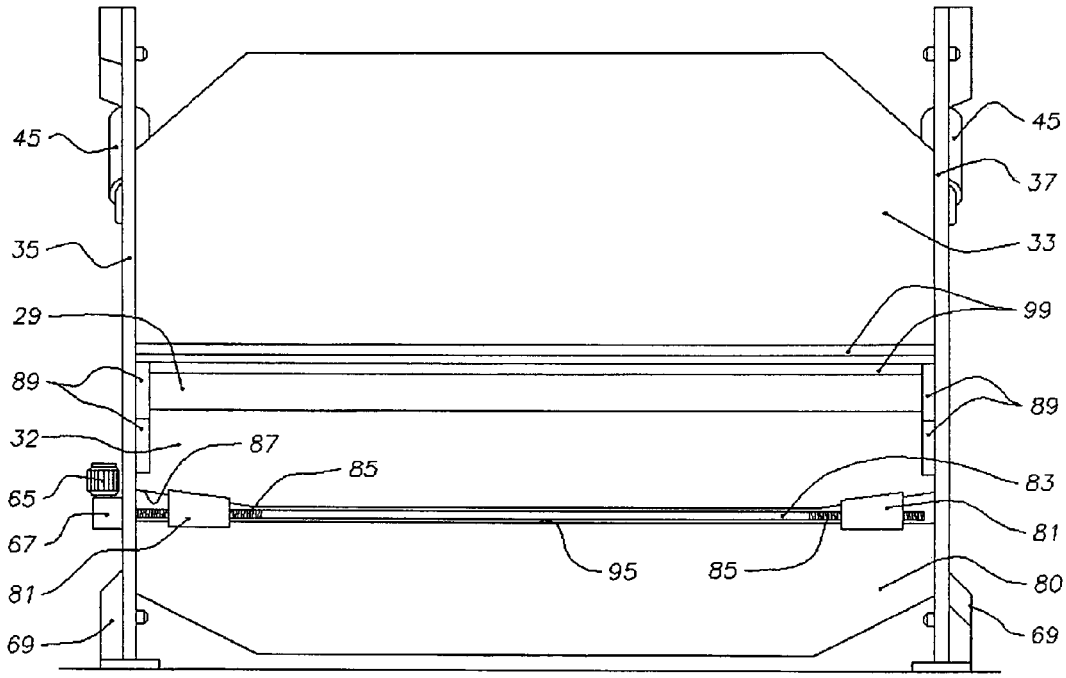
FIG. 12 is a rear elevation showing a fixed upper bending member, a lower bending member adjustable with wedges engaging opposite screw threads on a shaft driven in opposite directions by a motor and reduction gear. The wedges move inward or outward between the fixed bottom plate and the vertically slidable lower bending member to raise or lower the lower bending member.

As shown in FIG. 12, lower adjustable bending member 32 is supported above the bottom member 80 by shaped wedges 81 mounted on a shaft 83 with reverse threaded end portions 85. Motor 65 and speed reducer 67 turn shaft 83 in opposite directions to move wedges 81 inward to raise lower bending member 32, or to move wedges 81 outward to lower the member 32.

Wedges 81 slide on slopes 87 at ends of member 32 to raise or lower the bending member 32 and provide for bending thicker or thinner plates. Bending member 32 slides vertically between parallel guides 89 attached to the insides of side frames 35, 37. Bending member edges 99 engage the plate.

Figure 13:
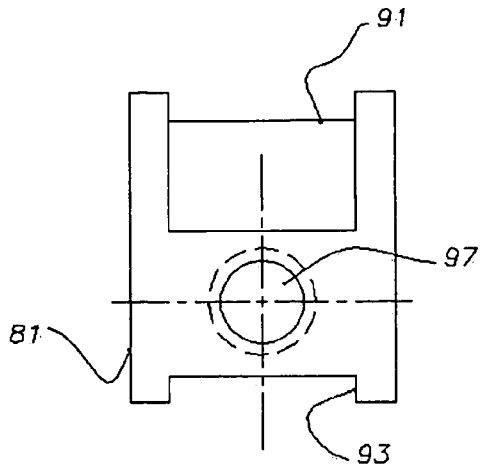
FIG. 13 is an end view detail of a wedge.

FIG. 13 is an end view of a wedge 81 showing upper and lower grooves 91 and 93. Groove 91 rides on lower edges of slopes 87 of the lower adjustable plate 32. Grooves 93 ride on the upper surface 95 of the fixed bottom member 80. Threaded bore 97 engages a threaded end portion 85 of shaft 83 to move the wedge inward and outward to raise and lower the adjustable lower plate 32.

Figure 14:
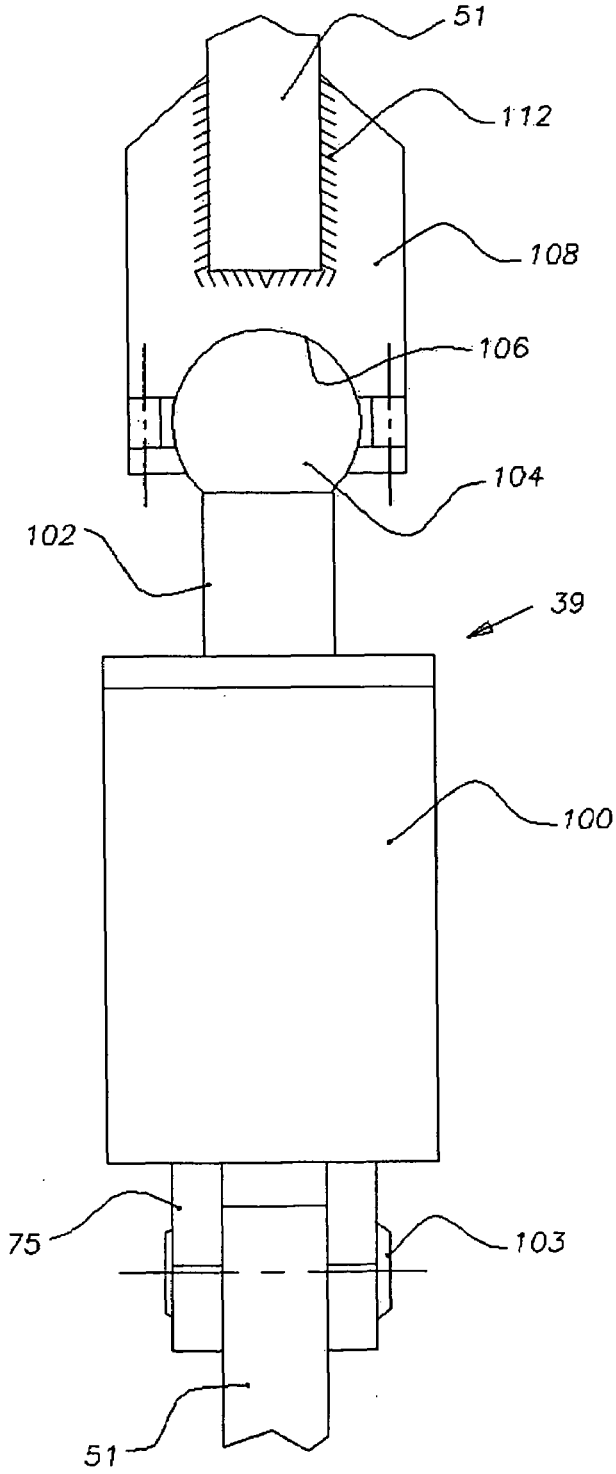
FIG. 14 is a detail of a ram connection between a side frame and a mobile frame end.

FIG. 14 is a detail of the main rams 39 showing the cylinder 100 and piston rod 102. The clevis 75 connected to the end of the cylinder is pinned with a pin 103 having upset end projection 51 on a side frame 35, 37, and the ball joint 77 connected to the piston rod. A ball 104 upset on the end of piston rod 102 is captured in a spherical bearing socket 106 in member 108. Retainer 110 holds the ball in the spherical bearing socket. Member 108 is welded 112 to a projection 53 on an end frame 41, 43.

Figure 15:
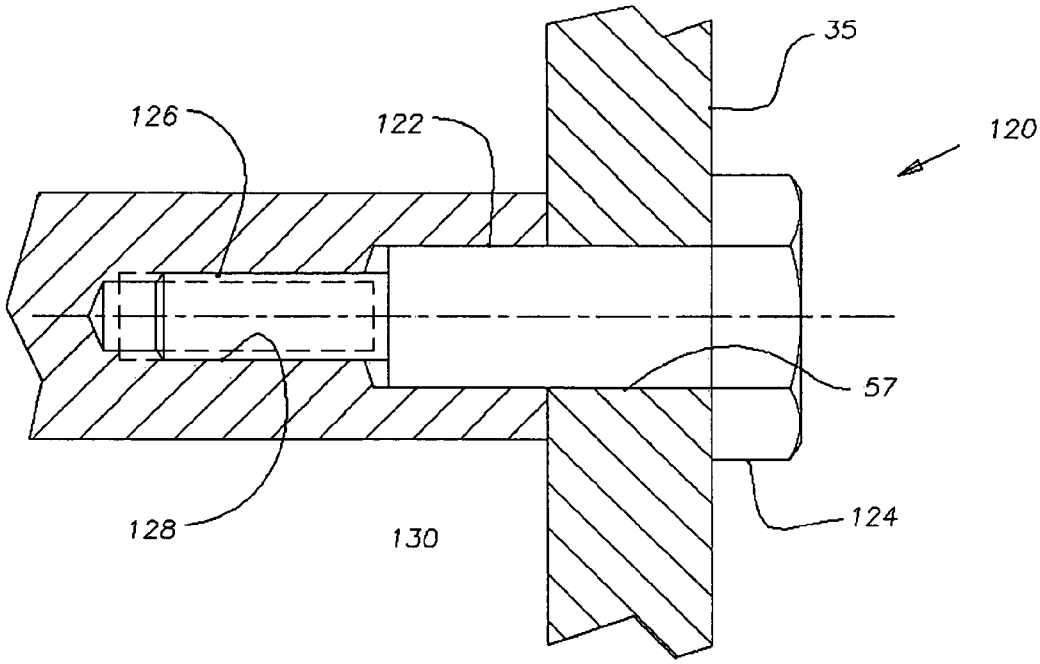
FIG. 15 is a detail of a bending member and side frame connection by a threaded and hex headed pin.

FIG. 15 is a detail of a threaded pin 120 with a bushing portion 122, which engages aligned bores 57, 130. A hexagonal head 124 turns a threaded end 126, which engages a threaded counterbore 128 at the end of bore 130 in a bending member.

Figure 16:
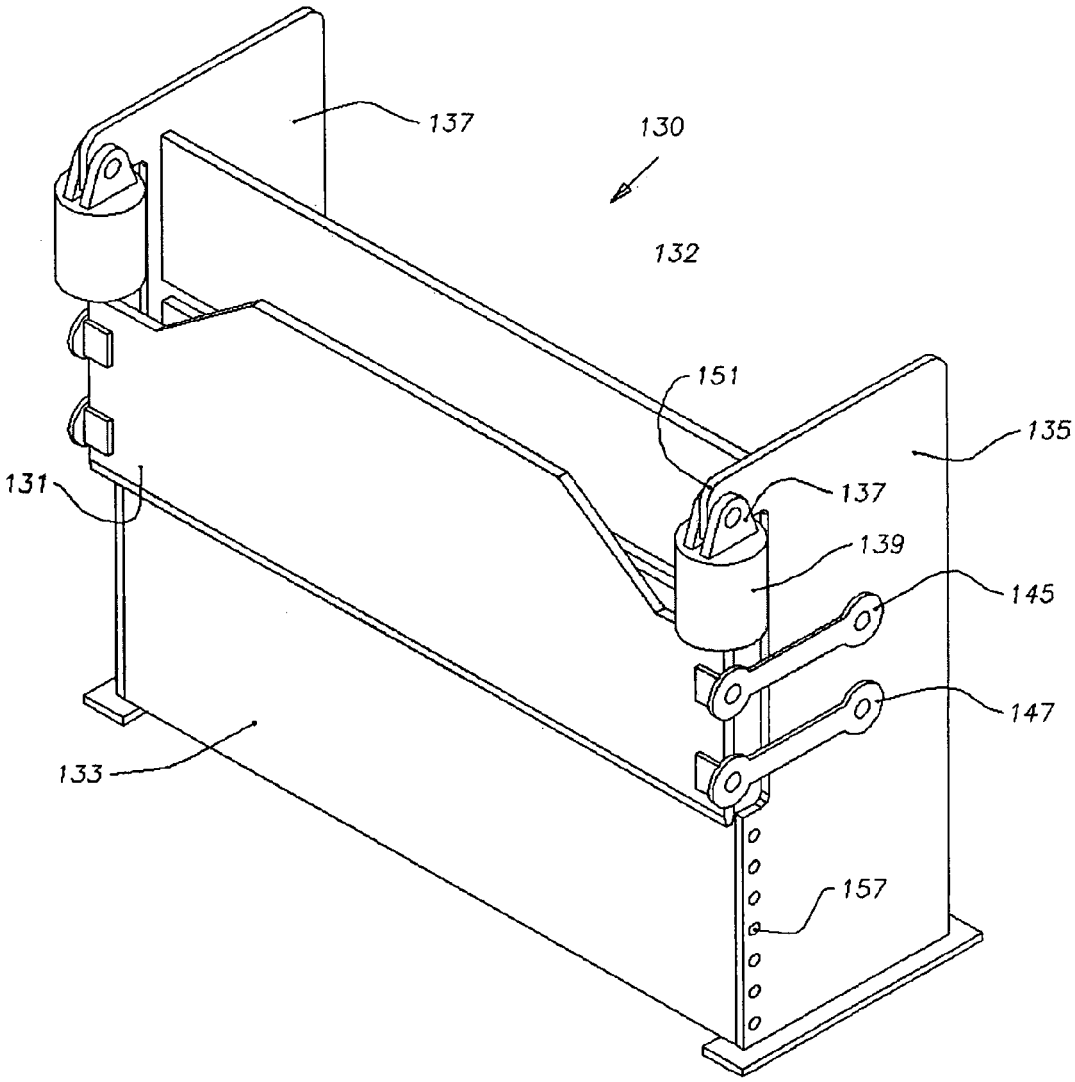
FIGS. 16-18 are perspective right side and top views of another embodiment of the invention.
Figure 17:
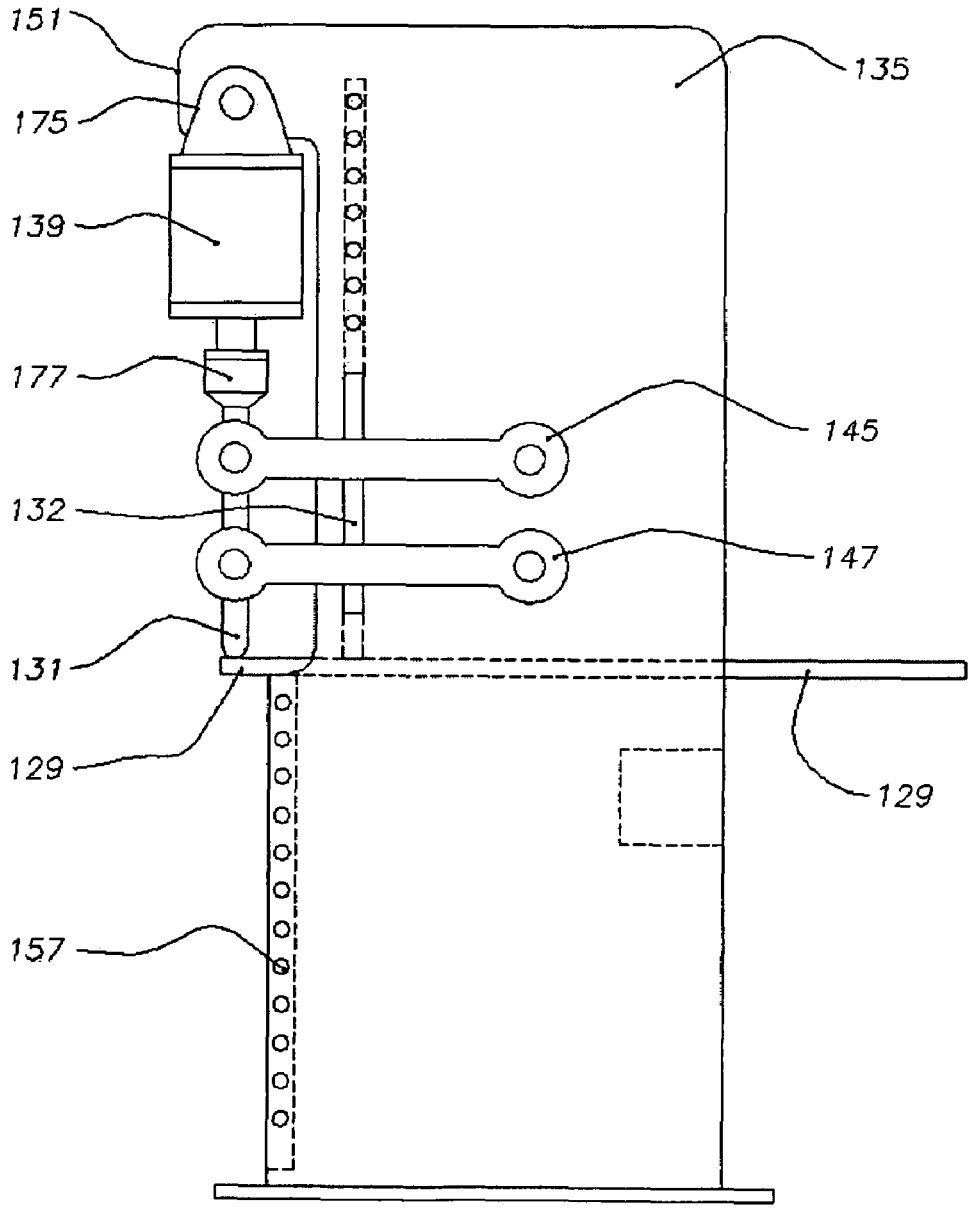
Figure 18:
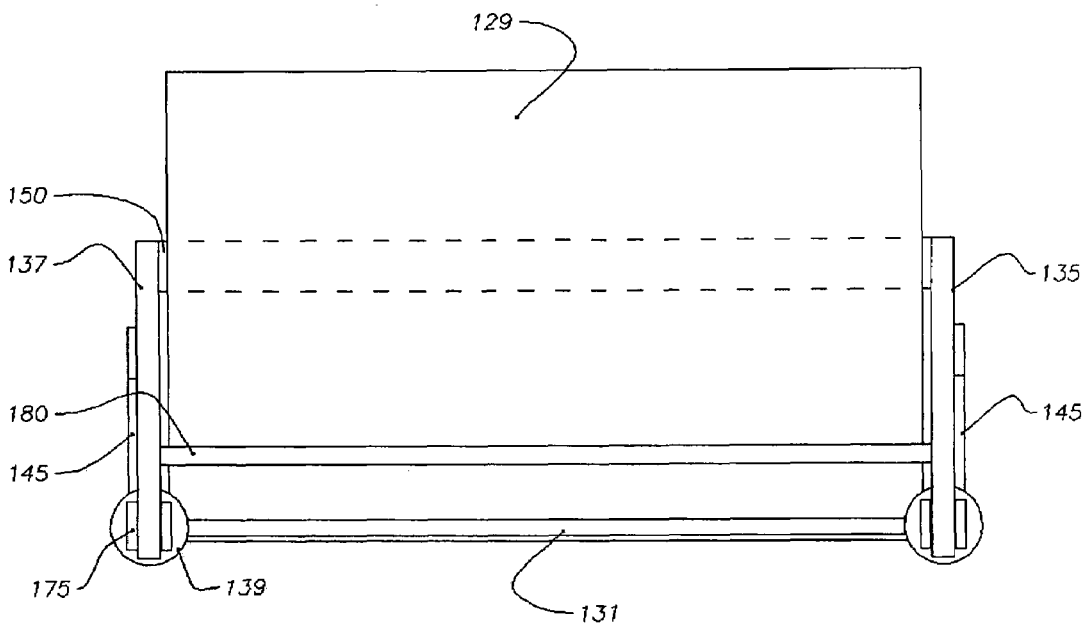

In an alternate form of the new bending machine 130 shown in FIGS. 16-18, parallel links 145, 147 are connected at first ends to a movable first bending member 131. Second ends of the links are connected to side frames 135, 137 of frame 136.

A second, upper bending member 132 is mounted between the side frames 135, 137. A rigid support 180 extends across the side frames above the upper bending member 132 to support adjustments of the bending member 132.

A central, third bending member 133 is mounted near a front of the side frames 135, 137 using pins in bores 157 in the side frames.

Main rams 139 drive the first bending member downward against a plate 129, bending the plate.

The rams have devises 175 connected to forward projections 151 of the side frames 137, 137 and spherical bearings 177 connected to the first, movable bending member 131.

A rigid brace 150 extends between the side frames 135, 137. The bending machine 130 step-by-step bends the leading area of plate 129 downward. When the bending members are rollers, the machine may operate continuously.

While the invention has been described with reference to specific embodiments, modifications and variations of the invention may be constructed without departing from the scope of the invention, which is defined in the following claims.

I claim:

1. Bending machine apparatus comprising:

a main frame, the main frame having first and second side frames;

mobile elements connected to the main frame for moving relatively to the main frame;

a mobile first bending member connected to a mobile frame for moving with the mobile elements with respect to the main frame;

a stationary second bending member connected between the first and second side frames and spaced inward in the main frame from the first bending member; and a stationary central third bending member connected between the first and second side frames and positioned between and in opposition to the first and second bending members.

2. The apparatus of claim 1, wherein the third bending member is a fixed upper plate fixed in position in the main frame, and the second bending member is a lower plate.

3. The apparatus of claim 2, wherein the lower plate is adjustable with respect to the upper plate.

4. The apparatus of claim 3, further comprising a bottom fixed plate and a shaft extending between the side frames beneath the lower plate, opposite threads on opposite ends of the shaft, a driver for rotating the shaft, and wedges mounted on the opposite ends of the shaft and positioned between the bottom plate and the lower plate for moving inwardly or outwardly to slightly raise or lower the lower plate between inward extending guides on inner surfaces of the first and second side frames.

5. The apparatus of claim 2, wherein the upper plate is connected to the side frames by threaded pins having bushing portions extending through aligned bores in the side frames and in the upper plate, and wherein the pins have threaded inner ends which engage threaded counter bores at inner ends of the bores in the plate.

6. The apparatus of claim 1, wherein the mobile elements have end frames connected to the main frame by parallel links pivoted on opposite ends to the side frames and to the end frames of the mobile frame.

7. The apparatus of claim 6, wherein the links comprise positioning rams for moving bottoms or tops or both tops and bottoms of the mobile frame end frames inward or outward for moving spaced alignment of the mobile first bending member with respect to the second and third bending members away from parallel alignment with or toward or away from the second and third bending members.

8. The apparatus of claim 6, further comprising guides extending outward from the side frames and overlying the links for constraining the links for movement in planes parallel to the side frames and the end frames.

9. The apparatus of claim 1, further comprising main rams connected between the side frames and the end frames of the mobile frame for moving the mobile frame and the mobile first bending member with respect to the side frames and second and third bending members.

10. The apparatus of claim 9, wherein the mobile frame end frames are in alignment with the side frames, wherein the main rams are in alignment between the side frames and the end frames and are connected between medial projections on the side frames extending toward the end frames, and end projections on the end frames extending toward the side frames.

11. The method of bending thick plates, comprising applying to a plate a central fixed force in one direction, applying in an opposite direction a fixed force spaced away from the central fixed force, and applying a mobile force in a direction opposite the central fixed force and spaced from the central fixed force in a position away from the central force and further away from the second fixed force.

12. The method of claim 11, wherein the second fixed force and the mobile force are additive and are balanced and resisted by the central fixed force.

13. The method of bending thick plates, comprising applying to a plate a central fixed force in one direction, applying in an opposite direction a fixed force spaced away from the central fixed force, and applying a mobile force in a direction opposite the central fixed force and spaced from the central fixed force in a position away from the central force and further away from the second fixed force, wherein the second fixed force is adjustable in spacing with respect to the central fixed force.

14. The method of claim 13, further comprising tipping the mobile force in an angular relation to the central fixed force.

15. The method of claim 13, further comprising providing a frame having spaced first and second side frames, providing a mobile first forcer spaced from the frame for providing a first mobile force to a plate, providing a second forcer in the frame spaced from the first forcer for providing a second force to the plate in a direction similar to the first force, providing a third forcer fixed in the frame and positioned between the first and second forcers for providing a third force to the plate in a direction opposite to the direction of the first and second forces, moving the first forcer toward the plate and bending the plate between the forcers, and forming the plate in a curve.

16. The method of claim 15, further comprising fixing the mobile first forcer in movable end plates aligned with and spaced from the side frames, connecting the side frames and adjacent end plates with parallel links and providing rams between the end plates and the side frames, moving the end plates and the first forcer toward the plate, and bending the plate.

17. The method of claim 16, further comprising providing guides on the side frames and guiding the links with the guides.

18. The method of claim 17, further comprising providing auxiliary rams as the links, and moving the end plates and the first forcer toward or away or tipped with respect to the second and third forcers.

19. The method of claim 15, wherein the forcers are supports having edges contacting the plate, and wherein the second support is mounted adjustably in the side frames, further comprising positioning a shaft having oppositely threaded end portions and providing wedges mounted on the end portion, and moving the wedges inward and outward by oppositely rotating the shaft for raising and lowering the second support.

* * * * *